US009657378B2

(12) United States Patent
Raykhtsaum

(10) Patent No.: US 9,657,378 B2
(45) Date of Patent: May 23, 2017

(54) PINK COLORED SILVER CONTAINING ALLOYS

(71) Applicant: RICHLINE GROUP, INC., New York, NY (US)

(72) Inventor: Grigory Raykhtsaum, Sharon, MA (US)

(73) Assignee: LeachGarner, Inc., Attleboro, MA (US)

( * ) Notice: Subject to any disclaimer, the term of this patent is extended or adjusted under 35 U.S.C. 154(b) by 367 days.

(21) Appl. No.: 14/271,016

(22) Filed: May 6, 2014

(65) Prior Publication Data

US 2014/0328717 A1 Nov. 6, 2014

Related U.S. Application Data

(60) Provisional application No. 61/819,902, filed on May 6, 2013.

(51) Int. Cl.

| | |
|---|---|
| ***C22C 9/00*** | (2006.01) |
| ***C22C 30/02*** | (2006.01) |
| ***C22C 5/08*** | (2006.01) |
| ***C22C 30/06*** | (2006.01) |
| ***A44C 27/00*** | (2006.01) |

(52) U.S. Cl.

CPC ..... *C22C 30/02* (2013.01); *A44C 27/003* (2013.01); *C22C 5/08* (2013.01); *C22C 9/00* (2013.01); *C22C 30/06* (2013.01)

(58) Field of Classification Search

None

See application file for complete search history.

(56) References Cited

U.S. PATENT DOCUMENTS

| | | | | |
|---|---|---|---|---|
| 4,446,102 | A * | 5/1984 | Bales | A44C 27/003 420/507 |
| 5,409,663 | A * | 4/1995 | Taylor | C22C 30/06 148/419 |
| 6,863,746 | B2 * | 3/2005 | Weinstein | A44C 27/003 148/433 |
| 9,194,024 | B1 * | 11/2015 | Butler | C22C 5/06 |
| 2010/0209287 | A1 * | 8/2010 | Bennett | C22C 5/06 420/476 |
| 2010/0322818 | A1 * | 12/2010 | Bridgeman | C22C 30/02 420/483 |
| 2013/0129562 | A1 * | 5/2013 | Grice | C22C 9/00 420/483 |

* cited by examiner

*Primary Examiner* — Colleen Dunn

(74) *Attorney, Agent, or Firm* — Gottlieb, Rackman & Reisman, P.C.

(57) ABSTRACT

The present invention is directed to a formulation of one or more low silver containing alloys (including those with silver content below 50 weight %, "w %") that show one of the group of distinct pink, yellow and green colors and further demonstrate enhanced resistance to tarnish and other beneficial features described herein.

11 Claims, No Drawings

PINK COLORED SILVER CONTAINING ALLOYS

BACKGROUND OF THE PRESENT INVENTION

A traditional silver-based jewelry alloy is comprised of sterling silver, which ordinarily contains 92.5% silver and the balance of the composition includes one or more base metals, typically including copper. In general, silver-based alloys with lower silver content show higher tarnish rates as compared with traditional sterling silver jewelry and therefore have not been used for jewelry making. Further, such low silver content alloys typically have issues of cost, such as the cost of alternative metals, as well as issues associated with tarnish avoidance, hardness, formability, and durability.

The recently rising cost of precious metals including silver has impacted the jewelry industry and has led to evolving markets for alternative alloys that contain low or no precious metals, and that retain the benefits of color, tarnish resistance, hardness, formability, and durability. Specifically, there is demand for low silver containing alloys that are tarnish resistant, can be used for jewelry making, and which may exhibit particular colors, such as but not limited to the traditional jewelry alloy colors of pink, yellow and green. These colors may be in different shades as well, such as different shades of pink, including pale shades.

Some work on developing low silver containing alloys has been done in the past, such as low silver containing alloys for jewelry contain 20%-25% silver by weight (w %), which are mixed with zinc, copper, and nickel. Depending on, the material mix, such alloys may appear in a pastel color, such as pink, green or yellow. However, the tarnish resistance of these alloys is compromised because of the low silver and high copper content.

As a result, there is a need in the jewelry industry for a variety of low silver containing alloys which individually display a particular color and also demonstrate improved performance with respect to formability as well as improved resistance to tarnish.

DESCRIPTION OF THE INVENTION

An objective of the present invention is a formulation of one or more low silver containing alloys (including those with silver content below 50 weight %, "w %") that show one of the group of distinct pink, yellow and green colors and further demonstrate enhanced resistance to tarnish and other beneficial features described herein.

In general, the present invention is directed to silver containing colored alloys which are formed of a composition comprising 20-29 w % silver (Ag), 0.5-3.0 w % palladium (Pd), 0.0-0.5 w % germanium (Ge), 0.0-0.3 w % silicon (Si), either 0.0-5.0 or 9.0-16.0 w % zinc (Zn), and the balance being copper (Cu). Such compositions have attributes of displaying in a particular shade of a color; either pink, yellow, or green, being resistant to tarnish; and have improved attributes of formability over those of comparable silver weight percentage jewelry.

In the alternative, the present invention is also directed to silver containing colored alloys with 35-50 w % Ag, 1.5-2.5 w % Pd and <1 w % of Si and Ge combined, These alloys tend to display paler versions of pink, yellow, or green, yet still maintain high tarnish resistance and characteristics of formability.

The present invention is directed to an alloy in combinations of the aforementioned elements so as to meet the combined needs of reduced material cost, resistance to tarnish, proper or desired coloring, and formability for use as jewelry.

The present invention is directed to an alloy comprising combinations of metals in various weight percentages which are silver based and which are of particular shades of pink, yellow, or green, and meet the requisite jewelry attributes of hardness, formability, and durability.

The alloys of the present invention all include silver. Copper serves multiple purposes in the present invention. One of copper's purposes is as a coloring agent in that the more copper in the alloy, the redder the alloy. However, the more copper in the alloy, the greater the tarnish rate. Another purpose to copper is to improve solubility of other elements. There must be a sufficient amount of copper in the alloy to provide for the solubility of small additions of the elements such as silicon and germanium.

Palladium is used herein primarily to reduce tarnish. Palladium also serves to whiten the alloy. That is, the more palladium in the alloy, the paler the resultant alloy may be.

Table 1 shows eight example alloys that have been formulated as a part of the present invention, each of which contains 50 w % or less silver (Ag) and shows pink, yellow or green color.

TABLE 1

| | w % | w % | w % | w % | w % | w % | CIELab (Measured) | | | |
|---|---|---|---|---|---|---|---|---|---|---|
| Alloy | Ag | Pd | Cu | Zn | Si | Ge | L* | a* | b* | Color |
| 1 | 50.0 | 2.0 | balance | | 0.1 | 0.5 | 88.0 | 3.0 | 11.5 | Pale Yellow |
| 2 | 48.7 | 2.0 | balance | | 0.2 | 0.7 | 88.0 | 2.2 | 11.4 | Pale Yellow |
| 3 | 48.7 | 2.0 | balance | | | | 87.0 | 4.5 | 11.5 | Pale Pink |
| 4 | 48.0 | 2.0 | balance | | 0.1 | | 87.0 | 4.5 | 11.5 | Pale Pink |
| 5 | 37.9 | 2.0 | balance | | 0.1 | | 89.0 | 5.0 | 11.0 | Pink |
| 6 | 27.8 | 2.0 | balance | | 0.2 | | 88.0 | 6.0 | 13.0 | Pink |
| 7 | 20.5 | 2.0 | balance | 3.0 | 0.4 | | 87.0 | 5.0 | 16.0 | Pink |
| 8 | 22.8 | 2.0 | balance | 10.0 | 0.2 | | 90.5 | 0.9 | 18.0 | Yellow |
| 9 | 22.8 | 2.0 | balance | 15.0 | 0.2 | | 90.5 | −1.3 | 19.0 | Green |

The first four alloys shown in the table include silver content in the alloy between 48 w % and 50 w % and the alloys appear in pale pink and pale yellow colors. The red-green component a* is below 5.0, and the yellow-blue component b* is below 13.0.

In the present invention, formability can be improved by adding small amounts of Si and/or Ge. However, adding too much can result in decreased ability for formation by causing brittleness. Adding too much or too little Ge can impact color. Preferably, Ge is used in a range of 0-0.5 w %, and when used, preferably at 0.2 w %. In the alloys shown in Table 1, Si is added to all the alloys except alloy 3 to further improve the resistance to tarnish. Ge is also added to alloys 1 and 2 to enhance the tarnish resistance even more.

The presence or lack of presence of Si and/or Ge can also impact color. For example, Alloy 2, which includes some Si and Ge displays a pale yellow color, whereas Alloy 3, which has additional copper in lieu of the Si and Ge of Alloy 2, displays a pale pink color.

For each example in Table 1, to improve the resistance to tarnish, 2 w % palladium (Pd) is included in each alloy. We find that 2 w % Pd is preferred because too much Pd can cause an increasing in color paling and too little Pd can impact tarnish improvement.

The better pink color with a*=5.0 and higher is observed for Alloys 5, 6, and 7 with silver content 37.9 w %, 27.8 w %, and 20.5 w % respectively. Alloy 5 however has a low 11.0 yellow component b*. Alloy 6, with a*=6.0 and b*=13.0, and alloy 7, with a*=5.0 and b*=16.0, may be considered improvements in color over allow 5.

Zinc (Zn), when used in combination with silver in appropriate percentages, can be used to color the silver so that the resultant alloy has a yellow, green, or yellowish-green color. With reference to the alloys of Table 1, Alloys 8 and 9 contain 10 w % and 15 w % Zn respectively so as to obtain distinct yellow and green colors respectively. In all the alloys, copper (Cu) content is added as a balance. Table 1 also lists the CIELab color coordinates L* (brightness component), a* (red-green component) and b (yellow-blue component) as measured for each alloy. Color coordinates are described in "Color Technology for Jewelry Applications", by D. P. Agarwal and G. Raykhtsaum, Proceedings of Santa Fe Symposium on Jewelry Manufacturing Technology, 1988, pp 229-244.

Alloys 8 and 9 each contain 22.8 w % silver and show distinct yellow and green colors respectively. Such distinct colors are achieved by selecting the zinc concentrations of 10 w % and 15 w % respectively for the alloys 8 and 9 with the high respective yellow components b* 18.0 and 19.0. The respective red-green component a* for these alloys are 0.9 and −1.3, respectively. The green color of the alloy 9 can be enhanced further by the increasing zinc content, which shifts the a* component to more negative value.

In order to result in a pink color, the CIELab measured attributes preferably need to be in the ranges of L* higher than 85, preferably 88.0, a* between 5.0 and 7.0, preferably 6.0, and b* higher than 12.0, preferably 13.0. To achieve this color, the weight percentages of each metal preferably should be in the ranges of 27%-38% Ag, 0.5%-3.0% Pd, 0.0%-0.3% Si and the balance being Cu. In the preferred embodiment, the composition includes 28.0 w % Ag, 2 w % Pd, 0.2% Si and the balance being Cu. In the preferred embodiment the density is 9.4 g/cm$^3$, the Annealed Hardness is 150 Vickers, the annealing temperature is 620 C., and the melting range, solidus to liquidus, is 785 C. to 965 C.

In order to result in a yellow color, the CIELab measured attributes need to is preferably be in the ranges of L* higher than 85, preferably 90.5, a* between −0.5 and 1.5, preferably 1.0, and b* higher than 17.5, preferably 18.0. To achieve this color, the weight percentages of each metal should preferably be in the ranges of 21%-25% Ag, 0.5%-3.0% Pd, 8%-12% Zn, 0.0%-0.3% Si and the balance being Cu. In the preferred embodiment, the composition includes 22.8 w % Ag, 2.0 w % Pd, 10% Zn, 0.2% Si and the balance being Cu. In the preferred embodiment the density is 9.0 g/cm$^3$, the Annealed Hardness is 60 Vickers, the annealing temperature is 620 C., and the melting range, solidus to liquidus, is 740 C. to 935 C.

In order to result in a green color, the CIELab measured attributes need to preferably be in the ranges of L* higher than 85, preferably 90.5, a* below −1.0, preferably −1.5, and b* higher than 18.5, preferably 19.0. To achieve this color, the weight percentages of each metal should preferably be in the ranges of 21%-24% Ag, 0.5%-3.0% Pd, 13%-17% Zn, 0.0-0.3% Si and the balance being Cu. In the preferred embodiment, the composition includes 22.8 w % Ag, 2.0 w % Pd, 15% Zn, 0.2% Si and the balance being Cu. In the preferred embodiment the density is 8.9 g/cm$^3$, the Annealed Hardness is 65 Vickers, the annealing temperature is 620 C., and the melting range, solidus to liquidus, is 715 C. to 905 C.

Data for example formulations, including pink, yellow, and green compositions, are included below.

Data for a formulated pink silver alloy (referred to as No. 433) follow. The alloy is formed of Gold, 28% Silver, and 2% Palladium. The density is 98.6 dwt/in$^3$ (9.4 g/cm$^3$). The color is pink. Color parameters are: Red-Green a*: 6.0 and Yellow b*: 13.0. The annealed hardness is 150 Vickers. The annealing temperature is 1150° F. (620° C.). The melting range (Solidus-Liquidus): 1445° F. (785° C.)-1770° F. (965° C.).

Data for a formulated yellow silver alloy (referred to as No. 434) follow. The alloy is formed of Gold, 22.8% Silver, and 2% Palladium. The density is 95.4 dwt/in$^3$ (9.0 g/cm$^3$). The color is yellow. Color parameters are: Red-Green a*: 0.9 and Yellow b*:18.5. The annealed hardness is 60 Vickers. The annealing temperature is 1150° F. (620° C.). The melting range (Solidus-Liquidus): 1365° F. (740° C.)-1715° F. (935° C.).

Data for a formulated green silver alloy (referred to as No. 436) follow. The alloy is formed of Gold, 22.8% Silver, and 2% Palladium. The density is 94.2 dwt/in$^3$ (8.9 g/cm$^3$). The color is green. Color parameters are: Red-Green a*: −1.3 and Yellow b*: 19.0. The annealed hardness is 65 Vickers. The annealing temperature is 1150° F. (620° C.). The melting range (Solidus-Liquidus): 1320° F. (715° C.)-1635° F. (905° C.).

Data for an additional formulated pink silver alloy (referred to as No. 433-2) follow. The alloy is formed of Gold, 20.5% Silver, and 2% Palladium. The density is 96.2 dwt/in$^3$ (9.1 g/cm$^3$). The color is pink. Color parameters are: Red-Green a*: 5.0 and Yellow b*: 16.0. The annealed hardness is 150 Vickers. The annealing temperature is 1150° F. (620° C.). The melting range (Solidus-Liquidus): 1445° F. (785° C.)-1770° F. (965° C.).

The invention claimed is:

1. A silver-based alloy composition comprising:
about 20-21% silver,
about 2% palladium,
about 3% zinc,
about 0.4% silicon,
copper, and absent gold.

2. The composition of claim 1, wherein the density is about 9 g/cm$^3$.

3. The composition of claim 1, which is used for making jewelry.

4. The composition of claim 1, wherein the composition exhibits a pink color and the annealed hardness is about 150 vickers.

5. The composition of claim 4, wherein the composition includes characteristics of resistance to tarnish.

6. The composition of claim 1, wherein said composition is exclusive of germanium.

7. The composition of claim 1, wherein said composition is further comprised of less than 0.7% germanium.

8. The composition of claim 1, where said composition is pink in color.

9. The composition of claim 8, where said composition is absent indium.

10. The composition of claim 8, where said composition is absent platinum.

11. The composition of claim 8, where said composition is absent gallium.

* * * * *